US007513002B2

(12) United States Patent
Best

(10) Patent No.: US 7,513,002 B2
(45) Date of Patent: Apr. 7, 2009

(54) INFLATABLE PILLOW STIFFENER WITH STABILIZING WEB AND ARMS

(76) Inventor: Alphonsus Best, P.O. Box 70, Southern Harbour, Newfoundland (CA) A0B 3H0

( * ) Notice: Subject to any disclaimer, the term of this patent is extended or adjusted under 35 U.S.C. 154(b) by 129 days.

(21) Appl. No.: 11/345,347

(22) Filed: Feb. 2, 2006

(65) Prior Publication Data

US 2007/0174970 A1 Aug. 2, 2007

(51) Int. Cl.
*A47C 20/00* (2006.01)

(52) U.S. Cl. ..... 5/655.3; 5/636; 5/644

(58) Field of Classification Search ..... 5/644, 5/636, 655.3
See application file for complete search history.

(56) References Cited

U.S. PATENT DOCUMENTS

| | | | | | |
|---|---|---|---|---|---|
| 655,087 | A | | 7/1900 | Jones | |
| 1,045,228 | A | | 11/1912 | Weltmer | |
| 2,688,142 | A | * | 9/1954 | Jensen | 5/638 |
| 2,792,576 | A | | 5/1957 | Coady | |
| 3,216,028 | A | | 11/1965 | Lawson | |
| 3,243,828 | A | | 4/1966 | McCarty | |
| 3,411,164 | A | | 11/1968 | Sumergrade | |
| D255,966 | S | * | 7/1980 | Stadel | D6/604 |
| 4,242,767 | A | | 1/1981 | McMullen et al. | |
| 4,393,530 | A | | 7/1983 | Stark | |
| 4,424,599 | A | | 1/1984 | Hannouche | |
| 4,501,034 | A | | 2/1985 | Greenawalt | |
| 4,528,705 | A | | 7/1985 | Greenawalt | |
| 4,550,459 | A | | 11/1985 | Endel et al. | |
| 4,597,386 | A | | 7/1986 | Goldstein | |
| 4,754,513 | A | | 7/1988 | Rinz | |
| 4,756,090 | A | | 7/1988 | Pedrow | |
| 4,768,248 | A | | 9/1988 | O'Sullivan | |
| 4,873,736 | A | | 10/1989 | Sapp et al. | |
| 4,905,332 | A | * | 3/1990 | Wang | 5/655.3 |
| 4,908,894 | A | | 3/1990 | Sanders | |
| 4,916,765 | A | | 4/1990 | Castronovo, Jr. | |
| 4,918,774 | A | | 4/1990 | Popitz | |
| 4,959,880 | A | * | 10/1990 | Tesch | 5/636 |
| 5,363,524 | A | * | 11/1994 | Lang | 5/640 |
| 5,457,832 | A | | 10/1995 | Tatum | |
| 5,953,777 | A | | 9/1999 | Buck | |
| 6,047,425 | A | | 4/2000 | Khazaal | |

(Continued)

FOREIGN PATENT DOCUMENTS

| | | |
|---|---|---|
| JP | 11-056561 | 2/1999 |

*Primary Examiner*—Patricia Engle
*Assistant Examiner*—William Kelleher
(74) *Attorney, Agent, or Firm*—Palmer C. DeMeo; Mario Theriault

(57) ABSTRACT

The pillow stiffener has an elongated cushion with a large rounded shape; two elongated arms each having a small rounded shape and being connected to and extending away from a long side of the elongated cushion. A flexible dull-finished web extends between the arms for retaining the arms at a fixed relationship with each other and with the elongated cushion. A joiner having the mentioned small rounded shape extends between and joins the extremities of both arms. Both arms and the joiner define with the elongated cushion a stabilizing rim around the dull-finished web for better retaining the pillow stiffener to a pillow. In another aspect, the pillow stiffener is made of a pair of flexible air-impermeable sheets and the elongated cushion, the arms and joiner form a single inflatable chamber.

17 Claims, 3 Drawing Sheets

U.S. PATENT DOCUMENTS 6,442,778 B1 9/2002 Shaharbani
6,487,737 B1 * 12/2002 Futagami ..... 5/644
6,490,743 B1 12/2002 Adat et al.
6,671,906 B1 1/2004 Milligan
7,146,665 B1 * 12/2006 Moorin ..... 5/644

* cited by examiner

INFLATABLE PILLOW STIFFENER WITH STABILIZING WEB AND ARMS

FIELD OF THE INVENTION

This invention pertains to orthopedic pillows and more particularly it pertains to a portable inflatable insert for stiffening a common pillow.

BACKGROUND OF THE INVENTION

Orthopedic pillows and pillow stiffeners have been used for many years for relieving different sleep disorders. While the benefits of a pillow stiffener in particular, are readily apparent when one of these stiffeners is used, the sleeping comfort is generally lost when the pillow stiffener is inadvertently displaced from a preferred region of the pillow, during one's sleep for example.

Although a pillow has a simple shape, every person uses it differently. Some prefer a thin region of the pillow, some prefer a thick portion, and others sleep on the long side of it. For that reason, when a pillow stiffener is used inside a common pillow having a common pillow case, it is important that this stiffener can be mounted in various ways relative to the pillow, and that it remains as mounted through the night.

It has been found that the stabilizing of a pillow stiffener inside a common pillow found in hotel rooms for example, has been generally overlooked in the past. In that regard, examples of orthopedic pillows and pillow stiffeners found in the prior art are shown in the following documents:

U.S. Pat. No. 655,087 issued to P. Jones on Jul. 31, 1900, discloses a pillow having an inflatable chamber integrated therein. The inflatable chamber is held inside the pillow by a sewn fabric partition.

U.S. Pat. No. 3,411,164 issued to S. Sumergrade on Nov. 19, 1968, discloses another type of pillow with an inflatable chamber permanently incorporated in a central portion thereof.

U.S. Pat. No. 4,754,513 issued to G. R. Rinz on Jul. 5, 1988, discloses a pillow case having a pocket formed along an edge thereof. A resilient insert is mounted in that pocket and is used to support the neck of the user. The modified pillow case can be used with a conventional pillow.

U.S. Pat. No. 4,768,248 issued to D. O'Sullivan on Sep. 6, 1988, discloses a pillow which is made of two compartments each covering the entire surface of the pillow. The upper compartment contains soft filler material and the lower compartment contains a neck support member. The neck support member has the shape of a cylindrical roll and is made of a firm but resilient material. This roll is positioned anywhere and in any orientation in the lower compartment of the pillow to accommodate the preferences of the user.

U.S. Pat. No. 6,490,743 issued to R. Adat et al. on Dec. 10, 2002, discloses a pillow case having a pair of neck support rolls affixed to the inside surface of the cover along opposite edges inside the cover. The modified pillow case can be used with a conventional pillow.

Although the modified pillows and pillow cases of the prior art deserve undeniable merits, the prior art fails to disclose or to suggest a pillow stiffener than can be inserted in a flat mode inside a common pillow, properly positioned and inflated to a desired size and stiffness. The prior art also fails to suggest a pillow insert that has retainers thereon to hold the insert during use in a proper position relative to a pillow.

As such, it is believed that there is a need in this field for a pillow stiffener that can be stowed in a flat or rolled-up shape inside one's luggage and easily mountable and effectively held in place inside a common pillow case.

SUMMARY OF THE INVENTION

In the present invention, however, there is provided a pillow stiffener that is transportable in a compact rolled-up or flat mode in a person's luggage, inserted inside a pillow case between the pillow and the pillow case of a common pillow found in hotel rooms, and inflated to a desired stiffness. The pillow stiffener according to the present invention has stabilizing web and arms thereon to embrace a portion of the pillow and to stabilize it against the pillow.

In one aspect of the present invention, there is provided a pillow stiffener with an elongated cushion having a large rounded shape; two elongated arms each having a small rounded shape and being connected to and extending away from, a long side of the elongated cushion. The pillow stiffener also has a flexible, dull-finished web extending between the arms, for retaining the arms at a fixed distance from each other and at a fixed angle from the elongated cushion, and for sticking to the surface of the pillow.

When the pillow stiffener is mounted between a pillow and the wall of a pillow case, a pressure on the pillow causes the formation of a bulge on the bottom surface of the pillow and causes this bulge to extend between the arms of the stiffener and against the dull-finished web, for better retaining the pillow stiffener in a proper position relative to the pillow.

In another aspect of the present invention, the pillow stiffener is made of a pair of flexible air-impermeable sheets and the elongated cushion and the arms form a single inflatable chamber. A manual air pump is connected to this chamber for inflating the stiffener. The pillow stiffener can be stowed away in a flat mode and can be inflated to a preferred stiffness prior to use.

In yet another aspect of the present invention, the pillow stiffener also has a joiner having the mentioned small rounded shape and extending between the extremities of both arms. In that aspect of the present invention, both arms and the joiner define with the elongated cushion a stabilizing rim around the dull-finished web for better retaining the pillow stiffener to a pillow.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

Two embodiments of the present invention are illustrated in the accompanying drawings, in which like numerals denote like parts throughout the several views, and in which.

DESCRIPTION OF THE PREFERRED EMBODIMENTS

Figure 1:
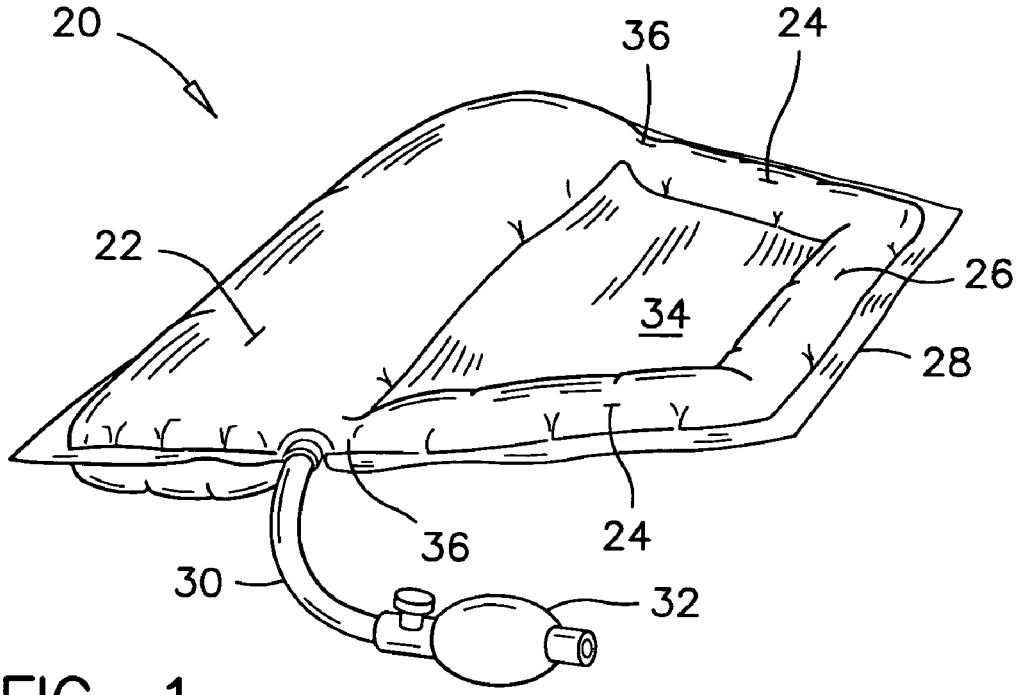
FIG. 1 is a perspective side and top view of a pillow stiffener according to a first preferred embodiment of the present invention.

While this invention is susceptible of embodiment in many different forms, there is shown in the drawings and will be described in details herein two specific embodiments of a pillow stiffener. The present disclosure is to be considered as an example of the principles of the invention and is not intended to limit the invention to the embodiments illustrated and described.

Referring firstly to FIG. 1, the pillow stiffener 20 according to the first preferred embodiment of the present invention is illustrated therein in an inflated mode. This pillow stiffener 20 comprises an elongated cushion 22 and a pair of arms 24 extending away from the cushion. The arms 24 are joined at their extremities by a transverse joiner 26. The arms are preferably longer that the width of the elongated cushion 22, to provide a retaining surface that is greater than the stiffened surface provided by the pillow stiffener 20.

The cushion 22, the arms 24 and the joiner 26 are formed from two flexible, air-impermeable sheets 28 superimposed over each other and welded together around the perimeter of these elements, in a way that is known to those skilled in the art of making inflatable mattresses and cushions for example. The cushion 22, the arms 24 and the joiner 26 are connected together to form a single inflatable chamber. The cushion 22, the arms 24 and the joiner 26 have a cylindrical shape, or ellipsoid or oblong cross-sections. All these shapes are commonly referred to herein as rounded shapes.

Although the cushion 22, has been illustrated with specific proportions relative to the overall shape of the pillow stiffener 20, it should be appreciated that the drawings are provided to facilitate the description of a first and second preferred embodiments only. This cushion 22 may have different shapes, and sizes corresponding for example to a small, medium or large pillow stiffener, to satisfy a larger number of users.

A hose 30 is connected to the mentioned inflatable chamber in a manner that is also known to those skilled in the art of inflatable mattresses and cushions. The hose 30 preferably has on its end a manual air pump 32 that is used to inflate the pillow stiffener 20 with ease.

The flexible sheets 28 define a web 34 between the arms 24 and the joiner 26, for retaining the arms 24 to each other. The web 34 is preferably made of non-slippery, dull-finished material and constitutes a surface which, in use, is in contact with the bottom surface of the pillow for stabilizing the stiffener against the pillow. The arms 24 and the joiner 26 enclose the web 34, for further stabilizing the stiffener against a pillow as will be further explained hereinafter.

The conduits 36 connecting the arms 24 to the cushion 22 have a reduced cross-section relative to the arms 24 such that these conduits 36 constitute a pair of hinges where the arms 24 are easily bent from the cushion 22 for better conforming to the shape of a pillow.

Figure 2:
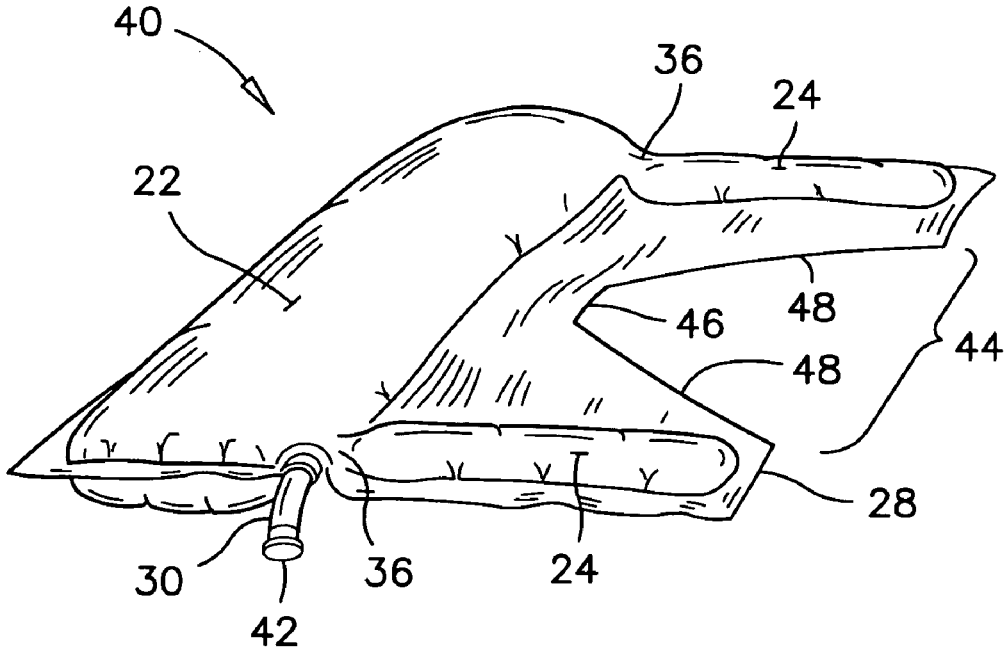
FIG. 2 is a perspective side and top view of a pillow stiffener according to a second preferred embodiment of the present invention.

Referring now to FIG. 2, the pillow stiffener 40 according to the second preferred embodiment of the present invention is illustrated therein. This second preferred pillow stiffener 40 is generally similar to the stiffener 20 according to the first preferred embodiment and therefore most parts thereof are labeled the same way in both drawings.

The pillow stiffener according to the second preferred embodiment 40 has a simple hose closure 42 for inflation by mouth instead of by a hand pump. The second preferred pillow stiffener also has spaced-apart arms 24 defining an open space 44 there-between. The web 46 between the arms 24 has a V-shaped notch therein defining a pair of gussets 48 that are attached to the cushion 22 and to the arms 24, for holding the arms 24 at about a right angle from the long side of the cushion 22. Again, the web 46 and the gussets 48 are made of dull-finished material. The web 46 and the gussets 48 have the double function of maintaining a friction between the surface of the stiffener 40 and the pillow and, maintaining the arms 24 at a fixed distance from each other.

Figure 4:
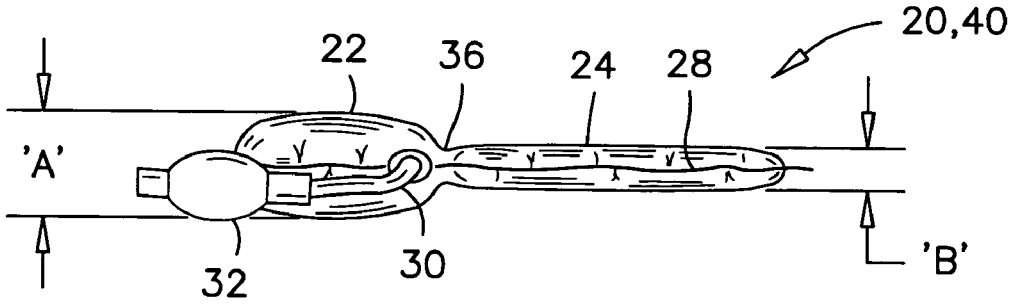
FIG. 4 is a side view of the pillow stiffener according to the first or second preferred embodiment, in an inflated mode.
Figure 5:
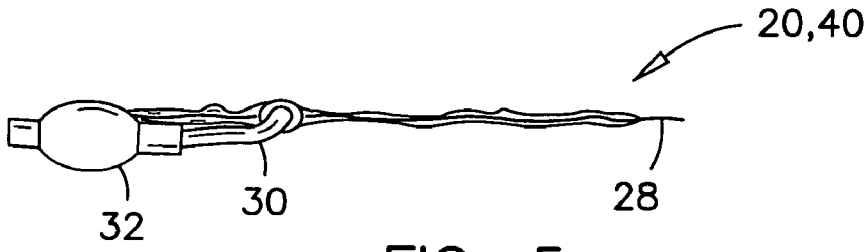
FIG. 5 is a side view of the pillow stiffener according to the first or second preferred embodiment, in a deflated mode.
Figure 6:
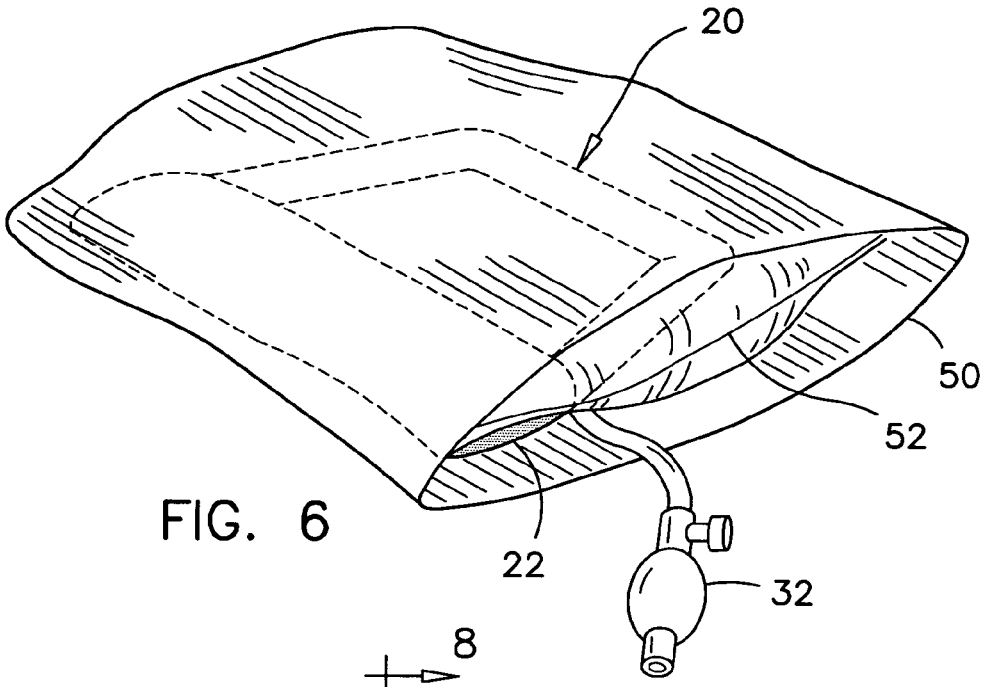
FIGS. 6 and 7 are a perspective view and an end view respectively of a pillow with the pillow stiffener according to the first preferred embodiment inserted inside the pillow case thereof.

Referring to FIGS. 4-5, both embodiments of the pillow stiffeners 20 and 40 have an elongated cushion 22 which is thicker than the arms 24. For reference purposes, the thickness 'A' of the elongated cushion 22 is about twice the thickness 'B' of the arms 24. When the pillow stiffeners 20 or 40 is deflated, if has substantially a flat shape as illustrated in FIG. 5 and can be rolled up in a compact arrangement (not shown) for storage in one's luggage for example.

Although the stiffener 40 according to the second preferred embodiment is slightly different from the first preferred stiffener 20 the operation and advantageous results of both embodiments are substantially the same, as will be understood from the following description, in which reference is made to the first preferred embodiment 20 only, for convenience.

Figure 7:
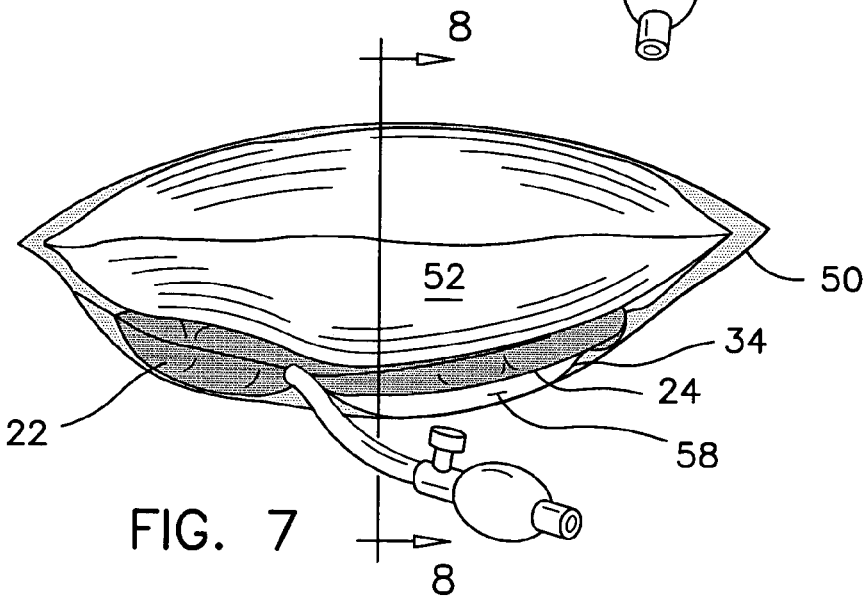

Referring now to FIGS. 3 and 6-8 the pillow stiffener 20 is inserted inside a pillow case 50 between the pillow 52 and the wall of the pillow case 50. The stiffener 20 is preferably inserted inside the pillow case in a flat mode, and inflated in place to a desired firmness. Because of the regions of reduced cross-section 36, the arms 24 have a natural tendency to bend transversely upward to conform to the roundness of the pillow 52 as shown in FIG. 7.

Figure 3:
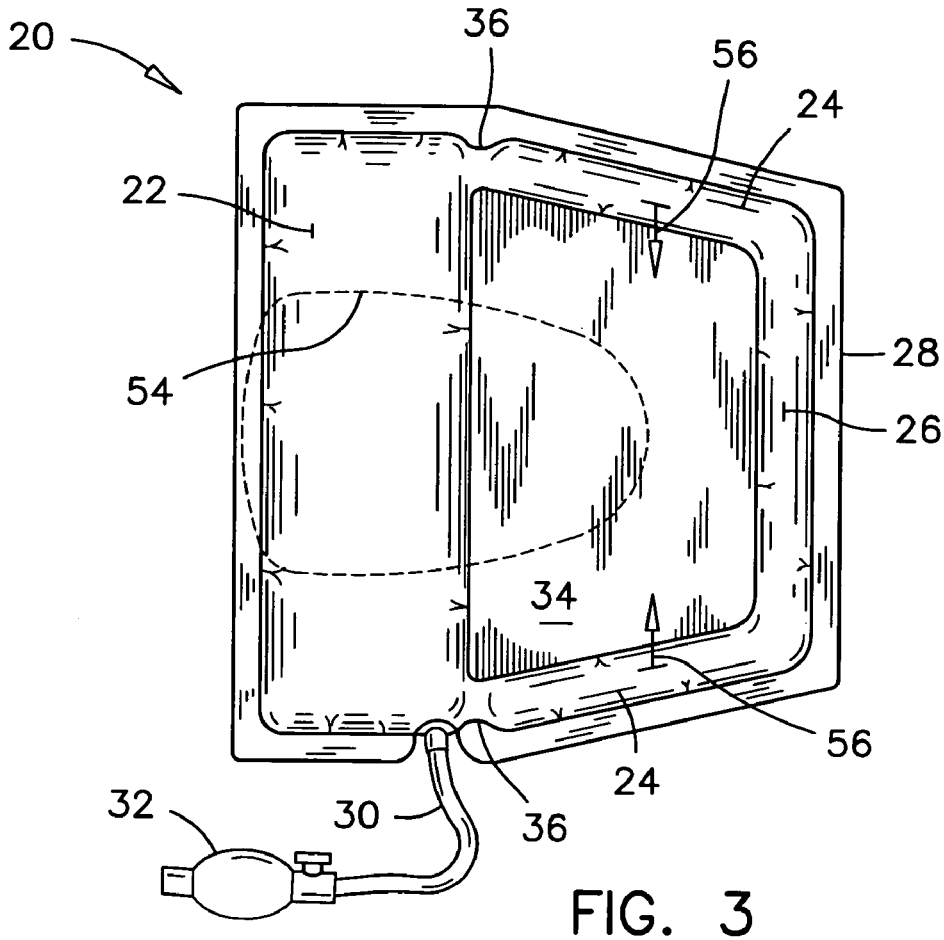
FIG. 3 is a top view of the pillow stiffener according to the first preferred embodiment.
Figure 8:
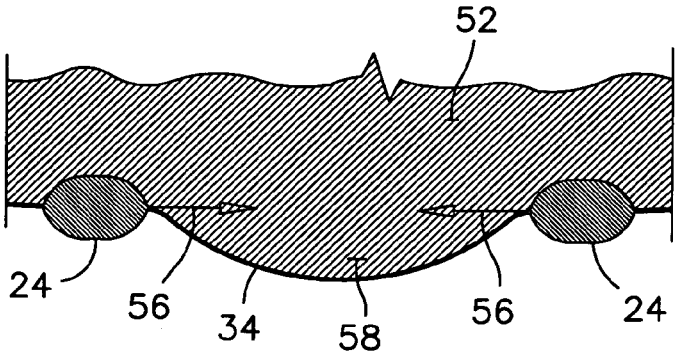
FIG. 8 is a cross section view of the pillow and the pillow stiffener as seen in FIG. 7 taken along the line 8-8 in FIG. 7.

A pressure on the surface of the pillow stiffener 20 and on the web 34, in a central region 54 thereof as represented in FIG. 3, causes the pillow stiffener 20 to bend longitudinally upward. Because the bottom surface of the pillow 52, rests against the web 34, the bending of the stiffener 20 longitudinally upward causes the web 34 to pull on the arms 24 to forced the arms 24 toward each other as illustrated by arrows 56. A pressure in the region 54 also causes the central portion of the pillow 52 to form a bulge 58 protruding between the arms 24. The pressure in the region 54 and the tension in the web 34 causes the arms 24 to embrace the bulge 58 as illustrated in FIGS. 7 and 8, and to retain the stiffener 20 in place.

It will be appreciated that the presence of the arms 24 promotes the formation of the bulge 58. The presence of the bulge 58 promotes the retention of the web 34 and of the arms 24 against the pillow 52 by increasing a surface pressure between the web 34, the arms 24 and the pillow 52.

It will be appreciated that the web 46 and the retention of the arms 24 by the gussets 48 in the second preferred embodiment 40 also contribute to retaining the pillow stiffener 40 in place relative to the bulge 58 formed under the pillow during use, in a same way as described for the first preferred embodiment.

As to other manner of usage and operation of the present invention, the same should be apparent from the above description and accompanying drawings, and accordingly further discussion relative to the manner of usage and operation of the invention would be considered repetitious and is not provided.

While two embodiments of pillow stiffeners having stabilizing arms have been illustrated and described herein above, it will be appreciated by those skilled in the art that various modifications, alternate constructions and equivalents may be employed without departing from the true spirit and scope of the invention. Therefore, the above description and the illustrations should not be construed as limiting the scope of the invention which is defined by the appended claims.

What is claimed is:

1. A pillow stiffener comprising an elongated air-inflated cushion having a large rounded shape; two elongated air-inflated arms each having a small rounded shape and a uniform cross-section being connected to and extending away from a long side of said elongated cushion; said small rounded shape of each of said arms being smaller than said large rounded shape of said elongated cushion; said long side of said elongated cushion and a length of said arms defining a plane thereof; a web extending between said arms and said elongated cushion for retaining said arms to said elongated cushion at a fixed distance from each other and each of said arms being connected to said elongated cushion by a hinge, said hinge being narrower in cross-section than said uniform cross-section of each of said arms.

2. The pillow stiffener as claimed in claim 1, wherein said web is made of a flexible dull-finished material extending between said arms.

3. The pillow stiffener as claimed in claim 2, wherein said elongated cushion and said arms form a single air-inflated chamber.

4. The pillow stiffener as claimed in claim 3, further comprising a hose connected to said air-inflated chamber, and a manual air pump connected to said hose.

5. The pillow stiffener as claimed in claim 3, wherein each of said arms is longer than a width of said elongated cushion.

6. The pillow as claimed in claim 3, wherein said large rounded shape is twice as thick as said small rounded shape.

7. The pillow stiffener as claimed in claim 3 further comprising a joiner having said small rounded shape and extending between and joining extremities of said arms.

8. The pillow stiffener as claimed in claim 7, wherein said elongated cushion, said arms and said joiner form a single air-inflated chamber.

9. The pillow stiffener as claimed in claim 8, wherein said elongated cushion, said arms, said joiner and said web are formed from two flexible and air-impermeable sheets superimposed over each other and welded around said elongated cushion, said arms and said joiner.

10. An inflatable pillow stiffener comprising an elongated cushion having a large rounded shape; two elongated arms each having a small rounded shape being connected to and extending away from a long side of said elongated cushion; said small rounded shape of each of said arms being smaller than said large rounded shape of said elongated cushion; each of said arms having a hinge forming a connection thereof to said elongated cushion; and a web made of flexible non-slippery material extending between said arms and said elongated cushion and defining gussets between said elongated cushion and said arms for retaining said arms at a fixed distance from each other; said hinge being a region of reduced thickness in said arm, perpendicular to said web.

11. The inflatable pillow stiffener as claimed in claim 10, wherein said elongated cushion and said arms form a single inflatable chamber.

12. In combination, a pillow case; a pillow mounted inside said pillow case and a pillow stiffener mounted between said pillow and said pillow case along an underside of said pillow, said pillow stiffener comprising; an elongated air-inflated cushion having a large rounded shape; two elongated air-inflated arms each having a small rounded shape, being connected to and extending away from a long side of said elongated cushion; said small rounded shape of each of said arms being smaller than said large rounded shape of said elongated cushion; each of said arms having hinge means at a connection thereof to said elongated cushion, and being bent transversely upward about said hinge means conforming to a roundness of said pillow; and a web extending between said arms and said elongated cushion for retaining said arms to said elongated cushion and at a fixed distance from each other; said hinge means being a region of reduced thickness in said arm, perpendicular to said web; said pillow having a bulge on a lower surface thereof and said arms embracing said bulge for retaining said pillow stiffener against said pillow.

13. The combination as claimed in claim 12, wherein said web is made of flexible dull-finished material.

14. The combination as claimed in claim 12, wherein said elongated air-inflated cushion and said air-inflated arms form a single air-inflated chamber.

15. The combination as claimed in claim 12, wherein each of said arms is longer than a width of said elongated cushion.

16. The combination as claimed in claim 12, wherein said large rounded shape is twice as thick as said small rounded shape.

17. The combination as claimed in claim 12 further comprising a joiner having said small rounded shape extending between and joining extremities of said arms.

* * * * *